United States Patent [19]

Strohmeyer, Jr.

[11] 4,453,495

[45] Jun. 12, 1984

[54] INTEGRATED CONTROL FOR A STEAM GENERATOR CIRCULATING FLUIDIZED BED FIRING SYSTEM

[75] Inventor: Charles Strohmeyer, Jr., Gladwyne, Pa.

[73] Assignee: Electrodyne Research Corporation, Gladwyne, Pa.

[21] Appl. No.: 519,190

[22] Filed: Aug. 1, 1983

Related U.S. Application Data

[63] Continuation-in-part of Ser. No. 477,920, Mar. 23, 1983.

[51] Int. Cl.[3] ..... F22B 1/00

[52] U.S. Cl. ..... 122/4 D; 110/245

[58] Field of Search ..... 122/4 D; 165/104.16; 110/245, 263; 431/7, 170

[56] References Cited

U.S. PATENT DOCUMENTS

| | | | |
|---|---|---|---|
| 3,902,462 | 9/1975 | Bryers | 122/4 D |
| 4,145,818 | 3/1979 | Kulcing | 34/57 A |
| 4,240,377 | 12/1980 | Johnson | 110/245 X |
| 4,250,839 | 2/1981 | Daman | 122/4 D |
| 4,336,769 | 1/1982 | Daman | 122/4 D |
| 4,397,267 | 8/1983 | Fink | 122/4 D |

*Primary Examiner*—Edward G. Favors

*Attorney, Agent, or Firm*—William J. Ruano

[57] ABSTRACT

The invention comprises an integrated control means, and particularly at partial loads, for a steam generator having a circulating fluidized bed combustion system wherein gas recirculation means is used to supplement combustion air flow to maintain gas velocity in the circulation loop sufficient to entrain and sustain particle mass flow rate at a level required to limit furnace gas temperature to a predetermined value as 1550 F. and wherein gas recirculation mass flow apportions heat transfer from the gas and recirculated particles among the respective portions of the steam generator fluid heat absorption circuits, gas and circulating particle mass flow rates being controlled selectively in a coordinated manner to complement each other in the apportionment of heat transfer optimally among the fluid heat absorption circuits while maintaining furnace gas temperature at a predetermined set point.

10 Claims, 4 Drawing Figures

INTEGRATED CONTROL FOR A STEAM GENERATOR CIRCULATING FLUIDIZED BED FIRING SYSTEM

This invention is a continuation-in-part to U.S. Pat. application Ser. No. 06/477,920 filed 03/23/83.

This invention relates to means for improving the performance of steam generators having fluidized bed combustion systems.

The temperature of a circulating bed is maintained substantially below that of a conventional firing system (1500 to 1700 vs 2500 to 3000 F). In order to hold the circulating bed temperature in a range of say 1550 F, some means of cooling is required. Air, gas and heat exchange surface provide such cooling means. The inert material in the bed acts as a flywheel and maintains temperature uniform throughout the length of the circulating bed through storage and transport of heat to downstream points. The mass of the inert material is many times greater than that of the fuel. Heat is extracted from the combustion circuit by the heat exchange surface in contact with the gas and solid inert particles.

Where the inert material can be cooled after it is separated from the gas at the end of the circulation loop, it will then need to be raised in temperature at the head end of the circulating bed after reinjection as it mixes with available fuel and air flow. The inert material then has a greater cooling effect upon the combustion process and a lesser amount of inert material needs to be recirculated for stabilizing combustion temperature in the recirculating loop.

This invention coordinates the improvements described in the U.S. patent application to which this application is a continuation-in-part and provides a new and novel means for controlling gas and circulating particle mass flow rates individually and in a coordinated manner to complement each other in the apportionment of heat transfer optimally among the fluid heat absorption circuits while maintaining furnace gas temperature at a predetermined set point.

Such improvements, superimposed upon the conventional steam generator combustion and feedwater control system components, provide greater unit reliability and safety through automatic adjustment of variables which would be difficult for the boiler operator to coordinate through manual control means.

Appreciation of the control parameters will assist the boiler designer to apportion the respective components of the fluid heat absorption circuits most advantageously throughout the gas path.

There are vast differences between fixed/bubbling and circulating fluidized bed designs. Fuel and air distribution are critical for the fixed/bubbling fluidized bed design. Control of recirculated particles is critical for the circulating fluidized bed design. For the circulating fluidized bed steam generator to realize its promised flexibility with respect to being capable of burning a wide variety of fuels, the unit must be capable of reapportioning heat absorption readily among the various fluid heat absorption circuits in a manner which can be clearly defined and through a process which is repeatable.

The capability to control a circulating fluidized bed differs substantially from that of a fixed/bubbling bed. For the circulating bed, the density of the bed and disposition of the bed solids along with heat input to the respective heat absorption circuits can be readily altered through coordinated manipulation of gas and recirculated solid particle mass flows. Gas injection at various furnace elevations biases the control response of gas mass flow change to recirculated particle mass flow. Such elements are useful tools for the boiler designer.

For the fixed/bubbling bed, the relationship between the bed and heat input to the respective heat absorption circuits remains fixed. Since the quality of the bed cannot be readily changed, it must either be shut down, started up or remain in operation at a high rating. Such type of control is elemental, of a stepped nature, and without modulating capability.

This invention distinguishes clearly between the two forms of fluidized beds. The objectives of this invention cannot be achieved through the use of a fixed/bubbling bed. There is no attempt to marry a fixed/bubbling bed with a circulating bed. The characteristics of the former are lost as is pointed out in the specification which follows.

A specific object of this invention is to provide a steam generator having a circulating fluidized bed combustion apparatus in association with fluid heat absorption circuits, means for selectively varying gas mass flow including recirculation of spent gas from a downstream point of the flue gas path, means for selectively varying mass flow rate of the recirculated bed particles, the said combined flow control means distributing heat generated by the combustion apparatus in a selective manner among various portions of the fluid heat absorption circuits, and especially during conditions of variable loading of the steam generator.

A further object is to selectively distribute heat generated by the combustion apparatus between steam generating and superheating service while holding the furnace gas temperature at a predetermined set point.

A still further object is to integrate selective control of rate of gas mass flow with selective control of mass flow rate of the recirculated solid particles to improve overall unit operating stability with minimum adverse interaction over a variable load range.

A still further object is to selectively modulate gas recirculation mass flow rate to return spray water utilized for superheated steam temperature control to a preset neutral value, thereby balancing heat absorption from the gas and recirculating particle flow stream among evaporating and superheating duties over a variable load range.

A still further object is to selectively modulate mass flow rate of the recirculated solid particles to selectively control furnace gas temperature over a variable load range.

A still further object is to selectively apportion gas recirculation mass flow between secondary and tertiary firing ports to bias quantity of mass flow of solid particles entrained in the gas stream when balancing heat absorption among the fluid circuits over a variable load range.

A still further object is to selectively control heat absorption apportionment between evaporating and superheating duties while selectively controlling gas temperature at an intermediate furnace zone as the secondary air ports independently of selective control of furnace outlet gas temperature.

A still further object is to selectively control excess air independently of the amount of gas mass flow required for solid particle entrainment through the circulating bed loop.

A still further object is to provide a means for selectively controlling storage of solid particles in the recirculating loop to accomodate selective increases and decreases in the solid particle mass flow rate.

A still further object is to provide a means for indexing ash removal from the circulating loop with selective control of the solid particle mass flow rate.

A still further object is to provide a means for stabilizing selective control of gas recirculation mass flow through indexing means associated with temperature measurement at the downstream end of the gas path which is representative of a shift in heat transfer distribution among selective portions of the fluid heat absorption circuits.

The invention will be described in detail with reference to the accompanying drawings wherein:

FIG. 4 is an alternative arrangement of the waterwall down-commer feed conduits from the drum.

Figure 1:
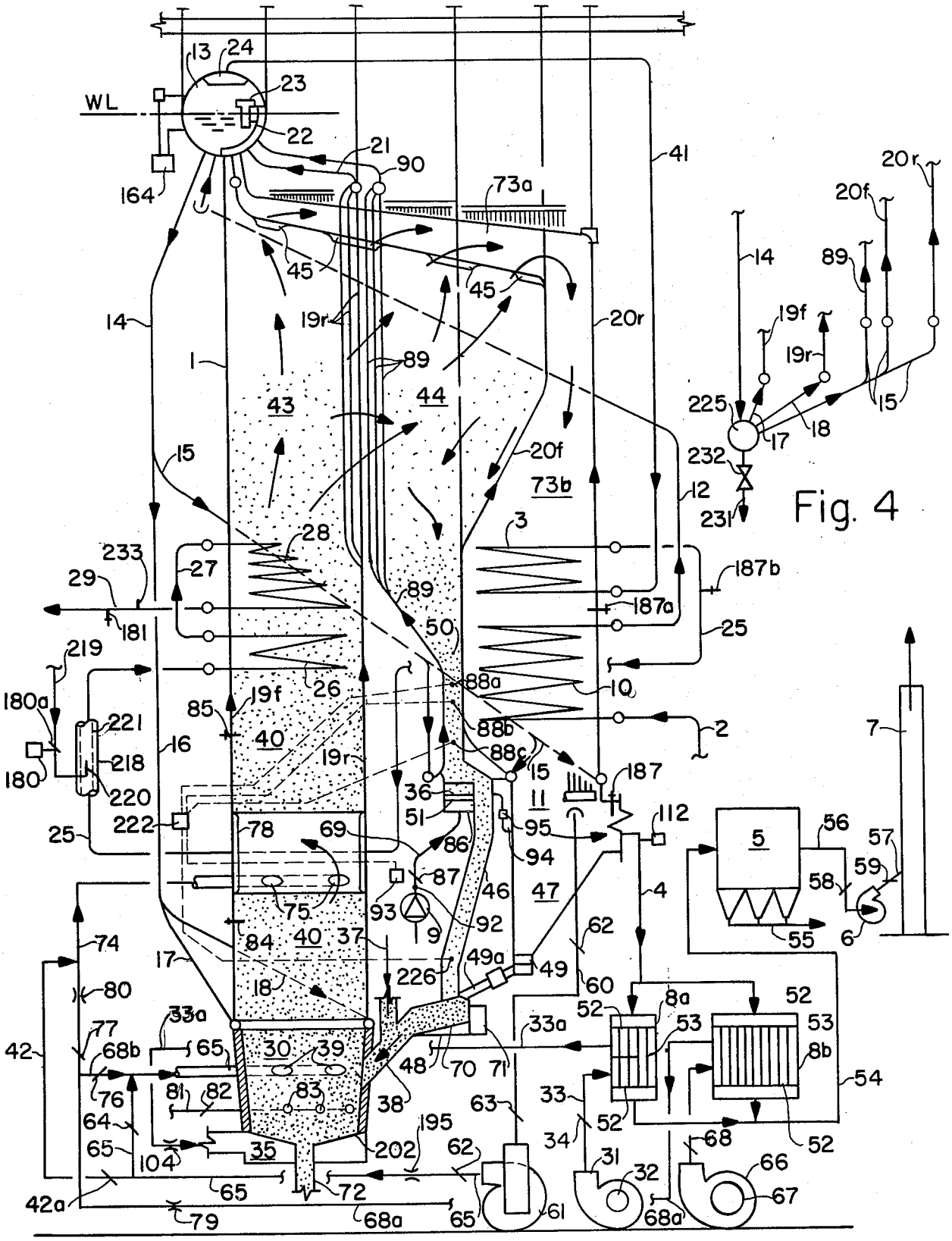
FIG. 1 is a schematic diagram of a steam generator having a circulating type fluidized bed in accordance with the objectives of the invention.

On FIG. 1, steam generator 1 is of a conventional design with regard to the fluid circuits. Feedwater at the working pressure enters the unit through conduit 2 which connects to economizer 10.

Effluent from economizer 10 passes through conduit 12 to drum 13 from whence it passes through conduits 14. 15, 16, 17 and 18 to lower waterwall headers which supply the furnace and convection pass waterwalls 19*f*, 19*r*, 20*f*, 20*r* and 89. The waterwalls, including sidewalls, floors and roof are of the membrane type. Waterwalls 19*f*, 20*f* and 20*r* discharge to drum 13. Rear furnace wall 19*r* is connected to drum 13 through conduit 21. Hopper floor 89 is connected to drum 13 through conduit 90.

Chemical treatment of the feedwater for steam generator 1 of FIG. 1 is of the volitile type for high pressure service which minimizes formation of solids in the steam generator water circuits. In cases where the steam generator is designed to operate at 950 psig and below and where feedwater treatment results in a buildup of solids in the water circuits, downcommer conduit 14 terminates in a mud drum 225 as shown on FIG. 4. Distribution conduits 15, 17 and 18 feed to the supply headers for waterwalls 19*f*, 19*r*, 20*f*, 20*r*, 89 and sidewalls.

Means are provided through conduit 231 and flow control valve 232 for continuous or periodic blowdown from mud drum 225 to remove accumulated sludge from the boiler water circulating system.

Baffle 22 within drum 13 (FIG. 1) directs the steam and water mixture to separators 23. Separated water exits from the bottom of separator 23 and joins with the feedwater from conduit 12 and is recirculated downward through conduit 14. Separated steam passes through the top of separators 23, through baffles and up through outlet screens 24 to conduit 41.

Steam from drum 13 passes through conduit 41 to the inlet header of primary superheater 3. Steam exits from the primary superheater 3 through conduit 25 to desuperheater 218 and superheaters 26 and 28 and out through conduit 29 to a steam consumer (not shown). Conduit 27 connects superheaters 26 and 28.

Water level WL in drum 13 is maintained at a fixed set point by control of feedwater flow through conduit 2.

Combustor 30 is of the fluidized type wherein particles of fuel and inert material are dispersed throughout the bed by agitation.

Primary air fan 31 takes air from atmosphere through inlet vanes 32 which control air flow. Primary air fan 31 discharges through duct 33 and shutoff damper 34 (for isolation purposes) to air heater 8*a*. The hot air then passes through duct 33*a* to plenum chamber 35.

Plenum chamber 35 feeds primary air to combustor 30 through sized holes in the floor 202 of combustor 30. A description of one possible floor construction is illustrated in the U.S. patent applications to which this application is a continuation in part.

Primary fuels, as coal, are fed to combustor 30 through conduit 37. Where $SO_2$ removal is required, limestone or equivalent is injected with the fuel through conduit 37. Secondary fuels as trash and waste products may enter combustor 30 along with the primary fuel through conduits 37 and 38.

Ignition begins in the lower portion of combustor 30 and as the particles of fuel and inert material rise in the base of the bed through displacement by fuel, limestone and inert material which are added through conduit 38, all in a fluidized state, they reach the level at which ports 39 are located. Ports 39 are close to the base of the bed. Ports 39 supply secondary air/gas flow which generates gas velocity in the furnace at this point sufficiently high to entrain desired quantities of bed solids in the gas stream, carrying such solids upward into furnace 40.

Supplemental air fan 66 takes air form atmosphere through inlet vanes 67 and discharges through duct 68 to air heater 8*b*, through ducts 68*a* and 68*b* to duct 65 and ports 39 or, alternatively, through duct 68*a* to duct 74 and ports 75. Ports 75 supply tertiary air/gas to the upper portion of the furnace 40 for control of gas temperature at the outlet of furnace 40.

Dampers 76 and 77 proportion supplemental air flow to secondary gas ports 39 or tertiary air ports 75 respectively. Inlet vanes 67 control total supplemental air flow.

Gas from plenum 11 is drawn through conduit 60 to gas recirculation fan 61. Dampers 62 are for isolation purposes. Damper 63 is for total gas flow control. Gas recirculation fan 61 discharges through duct 65 and proportioning damper 64 to secondary ports 39 or through duct 42 and proportioning damper 42*a* to tertiary gas ports 75.

The furnace walls in the vacinity of the tertiary air ports 75 may be studded and lined with refractory 78 to accelerate combustion in the area of refractory 78 and assist in the elevation of gas temperature at the outlet of furnace 40.

Ports 75 assist in raising the level of furnace outlet gas temperature to a value as 1700 F to increase heat transfer in the downstream surface 26, 28, 3 and 10 while maintaining gas temperature in the combustor 30 and area immediately above at a level as 1550 F.

Fuel is added to combustor 30 through conduit 38 and at this point it is thoroughly mixed throughout the bed.

Air is admitted to the combustor through sized holes in the floor 202 from plenum 35. The direction of air flow over floor 202 cools floor 202. This flow is only a portion of the total air flow required for combustion purposes. Additional air is added through secondary ports 39 and tertiary ports 75. Controlled air flow through the various points of entry (202, 39 and 75) regulates combustion rate in the associated furnace zones and assists in control of bed temperatures in these zones.

Gas recirculation flow through ports 39 and 75 supplements air flow and maintains gas velocity sufficiently high to entrain desired amounts of recirculated solid particles in the gas stream throughout the load range. Gas recirculation supplements or compements use of supplemental air for control of furnace gas temperature as well as balances heat absorption between evaporating and superheating duties.

Gas temperature above ports 39 is measured by thermocouple 84 and gas temperature above ports 75 is measured by thermocouple 85.

There is a gas velocity increase as the gas enters surface 26 and 28 in series after it leaves furnace 40. As heat is transferred from the gas and solid particles to the tube surfaces 26 and 28, gas temperature decreases. This reduces the specific volume of the gas as well as gas velocity for a given cross section area of the gas path.

The volumetric relationship within plenums 43 and 44 is such to permit the gas velocity to drop below entrainment level for the bulk of the solid particles at the outlet of platens 28 to permit settlement of the fuel and inert material particles which fall downward into hopper 50.

Gas passes from plenum 43 to plenum 44 through rear furnace wall tubes **19*r* and floor 89** riser tubes, at which points, the membranes are lacking and alternating tubes have been spread apart sufficiently to permit free passage of gas.

The tube configuration of surface 28 is such at the top of the bank to assist in uniform distribution of gas flow to plenums 43 and 44.

Gas flows upward to the top of plenums 43 and 44 where it exits through ports or orifices 45.

Ports 45 are located in the roof plane **20*f* and are formed by upsetting individual tubes for specific lengths from the plane of the tube and membrane sheet. Where the welded in membranes are of sufficient width, slots 45** can be formed by the omission of the membranes in specified locations.

Ports 45 are spaced and sized to create uniform gas distribution up through plenums 43 and 44. The overall configuration is such to avoid turbulance in the gas path as the gas flows from tube bank 28 through plenums 43 and 44 to ports 45.

Duct **73*a* is formed by the continuation of walls 20*f* and 20*r*, with a space between, over plenums 43 and 44. The walls 20*f* and 20*r* are of the membrane type for a tight enclosure. The sidewalls are an integral part of duct 73*a***.

Plenum **73*b* gas flows through primary syperheater 3 and economizer 10 to plenum 11**.

Solid particles collected in plenum 11 fall to hopper 47. Rotary feeder 49 is power driven and feeds dust from hopper 47 to recirculated particle feeder 48 through conduit **49*a*. Rotary feeder 49** is provided with a displacement type of seal to prevent reverse flow.

Gas from plenum 11 passes through duct 4 to air heaters **8*a* and 8*b***.

Air heaters **8*a* and 8*b* are provided with tube sheets 52 in which tubes 53 are mounted. The gas from duct 4 passes through tubes 53 to duct 54. Primary air fan 31 and supplemental air fan 66 discharge air flows around tubes 53. Gas duct 54 connects to bag house 5 where dust collection is completed. Dust separated in the bags is removed through conduits 55**.

Bag house 5 discharges through duct 56 to I. D. fan 6 and duct 57 to stack 7 and from thence to atmosphere. Dampers 58 and 59 are for isolation purposes and to regulate flow of gas so as to maintain a slightly negative pressure in furnace 40.

The walls of hopper 50 are formed by water cooled floor 89, rear pass waterwall **20*f*** and associated water-cooled sidewalls.

The hot separated fuel and inert solid particles which fall onto the horizontal projected surface of floor 89 and rear pass waterwall **20*f* at the bottom of plenums 43 and 44 transfer heat at high rates to these surfaces since the solid particles are in direct contact with the metal tubular heat exchange surface. At the projected particle temperature (1500 F), the particles are dry, not sticky and are free flowing. The temperature of the particles (ash) is below the softening and deformation temperature. They are glowing. The hot particles tumble down along tubular surface 20*f* and 89 on their way to hopper 50. Hopper 50** is constructed so that the particles are in dense compact association with the hopper walls.

In the configuration shown, a substantial amount of evaporation takes place as a result of the high rate of heat transfer between the hot separated solid particles and water cooled tubular surface **20*f* and 89. Floor 51 of hopper 50 is sloped downward in the direction of flow which is toward discharge conduit 46. Air distribution plates 36 are mounted on top of floor 51. Floor 51 is provided with holes (not shown) uniformfy spaced over the surface on close centers as 2 inches to supply air to distribution plates 36** above.

Blower 9 takes air from atmosphere and pressurizes it. The pressurized air discharges through conduit 69 to plenum 86 where it is distributed through holes in floor 51 to distribution plates 36 mounted on floor 51.

Distribution plates 36 are porous and the flow of air up though them permeates the mass of solid inert particles immediately above floor 51, fluidizing the solid particles to the point of permitting them to slide down floor 51 incline and dump into discharge conduit 46 from whence they feed to recirculated particle feeder 48 for recycle to combustor 30 through conduit 38.

Plenum 86 may be segmented in the direction transverse to the plane of FIG. 1 drawing to serve individual portions of distribution plates 36 by control of air distribution to the individual segments of plenum 86. In such case, blower 9 discharge conduit forms a distribution manifold at point 92. Air to the individual segments would be controlled by flow control means 87, one of which would be located in the feed conduit 69 to each plenum 86 segment.

Blower 9 is provided with relief means (not shown) to permit discharge air flow from the blower to vary as a consequence of the throttling action of control means 87.

Modulation of flow control means 87 permits regulation of the rate at which inert material particles spill over from hopper 50 to discharge conduit 46. Flow control means 87 incorporates power actuated means 93 which is responsive to hopper 50 level controller 222.

Controller 222 is responsive to multiple levels as **88*a*, 88*b* and 88*c* for the respective individual plenum 86 segments. The individual throttling means 87 are controlled to maintain level in an individual segment between two preset points as 88***a* and 88*b* or between 88*b* and 88*c*.

Throttling position of means 87 may be altered continuously or in steps over a period of time until the desired flow rate is achieved.

Measurement of solid particle density at point 226 is also factored into level controller 222. Low density is over riding. It accellerates removal of solids from hopper 50 and retards removal of ash from combustor 30 through conduit 72 (not shown) if the level of hopper 50 is low.

It is not intended that fluidizing air from blower 9 passing through air distribution plates 36 pass up through hopper 50, thereby fluidizing the inert material stored in hopper 50. The fluidizing air from blower 9 passes with the solid particles to discharge conduit 46 where it can be discharged to plenum 11 through relief conduit 94 and back pressure valve 95. Back pressure valve 95 is set for a low differential pressure to eliminate unnecessary heat escape from conduit 46. Expansion joints (not shown) permit movement between equipment pieces.

As a result of the heat given up by the solid particles to surface 89 and 20*f*, the particles must be reheated after they are returned to combustor 30. This requires an increase in firing rate which can be accomplished without raising the temperature of the bed above set point. The net effect of the regenerative heating function of the recirculated solid particles is to make available more high temperature energy to the steam generator fluid circuits. This is important in the case of units having substantial superheating and reheating requirements at high pressure. This normalizes the configuration of the low temperature end of the circulating fluidized bed boiler.

The recirculating loop of the circulating fluidized bed combustion system can be described as follows: The combustor 10 contains a bubbling bed below ports 39 which serves as a classifier/igniter. The lower bed overflows above the secondary gas ports 39 by addition of fuel, limestone and recirculated solid particles through conduit 38. Gas flow through ports 39 lifts the recirculating bed materials up into furnace 40 as a result of furnace gas velocities in the entrainment range (16 to 25 foot/sec.). The lower part of the furnace functions as a pulverizer. Solid particles carried over into plenums 43 and 44 are collected in hopper 50 as gas velocity in plenums 43 and 44 drops below entrainment value (4 to 8 foot/sec.). Hopper 50 collects separated solid material after heat exchange with circuits 20*f* and 89.

Solids from hopper 50 are discharged into conduit 46 which connects to recirculated particle feeder 48 below. From feeder 48, solid particles pass through conduit 38 and back to combustor 30 for recycle.

Recirculating solid particle feeder 48 consists of a vibrating plate 70 which is driven by variable speed means 71 to cause solid particles in conduit 46 to pass through feeder 48 at a preset rate. Variable speed means 71 receives inputs from a sonic density and flow measuring device incorporated as part of the variable speed control. Alternatively, an air slide could be provided similar in construction to elements 51, 36, 9, 69 and 86 as described above. An air lift as described in the U.S. patent application to which this application is a continuation-in-part could also be provided. See elements 48, 69, 70 and 71 of such application. The type of feed device is not a specific part of this invention.

Ash can be removed from the circulating loop through the opening at the bottom of combustor 30 through conduit 72. Ash is removed on a continuous basis to maintain equilibrium in the combustion system. Methods are known for removal of ash from combustor 30 at a controlled rate on a continuous basis. A counter flow of gas up through conduit 72 will classify the size of the ash particles removed from combustor 30 through conduit 72. The greater the counter flow, the more dense and larger will be the material which passes through.

Oil or gas can be admitted through conduit 81, flow control means 82 and nozzles 83 into combustor 30 for firing during unit startup or for use as a supplemental or emergency fuel during times when solid fuel supply has been interrupted. Nozzles 83 are equipped with ignition means.

COMPARISON OF FIXED/BUBBLING VS. CIRCULATING FLUIDIZED BED BOILER COMBUSTION SYSTEMS

While both types of systems may belong to the same general class they are considerably different from structural and operating considerations.

A circulating bed can be superimposed on top of the base portion of a fixed/bubbling bed but the characteristics of the fixed/bubbling fluidized bed are basically lost. In such case stability of the base bed is not an issue. It can be agitated considerably to direct trash to the exit port for removal. The base can be used as a classifier and fuel preparation zone. Immersed cooling circuits are not needed in the base bed as the heat released in this zone heats the primary air entering from the bottom of the bed, provides ignition energy to fire the fuel admitted at this point and vaporizes the moisture introduced with the fuel. The heat is also used to raise the temperature of the air and gas admitted through secondary ports 39. Coal gasification along with the formation of hydrogen sulphide is not anticipated. Limestome calcination is endothermic and absorbs heat. Sulphur capture from calcium oxide above the base is exothermic and releases heat. The base bed receives a very limited supply of air required for total combustion of the fuel. The superficial velocity of the gas in the base bed is in a range of 8 foot/sec. The bed is very shallow (approximately 2 feet).

Air/gas velocity through a conventional fixed bubbling bed is limited to a maximum of about 8 foot/sec. above which excessive solids leave the bed similar to the case of a circulating bed described herein. Combustion rate depends upon the amount of air available to react with the fuel. Thus, the horizontal cross section area of the fixed/bubbling bed is a function of air/gas velocity leaving the bed. Since the air/gas velocity is about one third that of a furnace for a conventional boiler, the horizontal cross section area for a fixed/bubbling bed is about three times as large as that for a conventional boiler furnace. The horizontal cross section area of a circulating fluidized bed, due to the higher gas velocity, is about the same as that for a conventional furnace.

The combustion process for a fixed/bubbling bed is a localized reaction. The bed has a fixed mass consistency and is suited only for constant loading with minimal turndown. Load variations are normally achieved through zoning the bed and putting zones into and taking zones out of service. Inbed heat exchange surface immersed throughout the bed compartmentalizes the bed still further and great care must be taken to distribute air and fuel uniformly to many locations throughout the bed. Such type of configuration is of a horizontal nature and is best suited for a monolithic type of heat transfer duty as generating low pressure saturated steam.

On the other hand, the combustion process for a circulating bed is a unitized system without compartmentalization. Mixing within the bed is complete. The bed is not subject to hot spots resulting from air deficiency or clumps of fuel which are unevenly dispersed throughout the bed. A circulating fluidized bed is a vertical configuration. Horizontal dispersion within the bed is achieved through tangential admission of secondary air across a rotating migrating base bed in the case illustrated herein. The rotational pattern is generated by primary air admission in the direction of rotation and tangentially with the plane of the floor. The turbulence generated in the combustion zone is similar to that of a conventional boiler firing system.

In the circulating fluidized bed, heat transfer is at the periphery of the vertical furnace. Solids in the gas stream transport and exchange heat with the fluid heat absorption circuits both before and after separation of the particulate from the gas stream.

All of the above permits the circulating fluidized bed to be used at the high end of the scale which is characterized by large amounts of superheating and reheating duty along with steam generation at high pressure.

The fixed/circulating bed has high inertial effects and is a process of averaging. This applies to both steam generating and superheating services. Coordination of the two during fast load changes is not possible.

The circulating fluidized bed, on the other hand, can avail itself of those characteristics of a conventional steam generator furnace which enable fast load changes to be made. In a conventional furnace, gas temperature declines as load and firing rate are decreased. For the circulating fluided bed, recirculated solid particles are utilized in the high load range to limit rise of furnace temperature above say 1550 F. As load is reduced the mass flow quantity of the recirculated solid particles can be deminished to maintain furnace temperature suitable for ignition and heat transfer purposes. Also, depth of penetration of the constant temperature zone can be reduced.

Time constants associated with variations in solid particle mass flow recirculation rates closely parallel those associated with the inertial effects of stored heat in the heat exchange surface structural metals. The two reactions can be coordinated to advantage. The structural metal heat storage gives stability to the fluid circuit outlet temperatures. The hot recirculating particulate gives stability to the state of ignition within the overall combustion system.

It should be noted that in the circulating fluidized bed the whole recirculation loop is in a state of ignition and is not subject to a rapid flame out as can happen in a conventional boiler. The same is true for the fixed/bubbling bed.

The phenomena of fluidized beds is not new either as applies to fixed/bubbling or circulating bed types. The application features which make such phenomena viable are the basis for unique claims.

The circulating bed phenomena has a close parallel to overfire air systems associated with stoker firing which were designed to capture and consume particles of unburned solid fuel which became disengaged from the stoker bed and were carried up by the flue gas leaving the bed into the furnace and through the boiler tube section. Such solids were captured in a lower temperature zone of the gas stream by a mechanical dust collector where the separated dust fell to a quiescent zone in the form of a hopper The collected particles, high in carbon content, were withdrawn from the hopper through a conduit to an eductor powered by a source of overfire air flow (10 percent or more of the total air flow). The overfire air along with the collected particles were injected over the stoker for recycle of the solid particles so that they could be consumed in the furnace. Much ash was reinjected as well as recirculated.

Such systems were popular in the late 1940's and 1950's. The steam generators at the Hickling and Jennison Stations of the New York State Electric and Gas Company are excellent examples. CIRCULATING FLUIDIZED BED BOILER DIRECT NON-INTERACTIVE RESPONSE CHARACTERISTICS TO STEP CHANGES OF A SINGLE INPUT VARIABLE are:

FEEDWATER FLOW: Change in steam drum water level (boiler output).

FUEL FLOW: Change in steam pressure (boiler output).

AIR FLOW: Change in flue gas $O_2$ level.

SECONDARY/TERTIARY AIR DISTRIBUTION: Bias furnace gas temperatures in lower and upper zones.

SPRAY WATER FLOW: Superheater outlet steam temperature change, bias evaporating and superheating duty.

SOLID PARTICLE RECIRCULATION MASS FLOW: Furnace gas temperature change, bias heat absorption between furnace and downstream gas path.

LEVEL IN HOPPER 50: Change in solid particle incycle storage.

ASH REMOVAL: Change in solid particle total inventory in cycle circulatory system.

GAS RECIRCULATION MASS FLOW: Change gas velocity in furnace and degree of particle entrainment in the gas stream, vary furnace gas temperature, vary heat absorption in the furnace and downstream zones (one increasing, the other decreasing), vary size of particle carried through plenums 43 and 44 to baghouse.

GAS RECIRCULATION TERTIARY PORT BALANCING DAMPER: Bias gas recirculation effect upon degree of particle entrainment in the gas stream.

For high level steam generators it is necessary to be able to control heat input selectively to the respective evaporating, superheating and reheating heat absorption circuits. This requires manipulation of the variables which enable reapportionment of heat input among the respective heat apsorption circuits.

This invention relates to non-interactive control means for redistributing heat absorption among the respective fluid heat absorption circuits and particularly as concerns superheating and evaporating duties.

Figure 2:
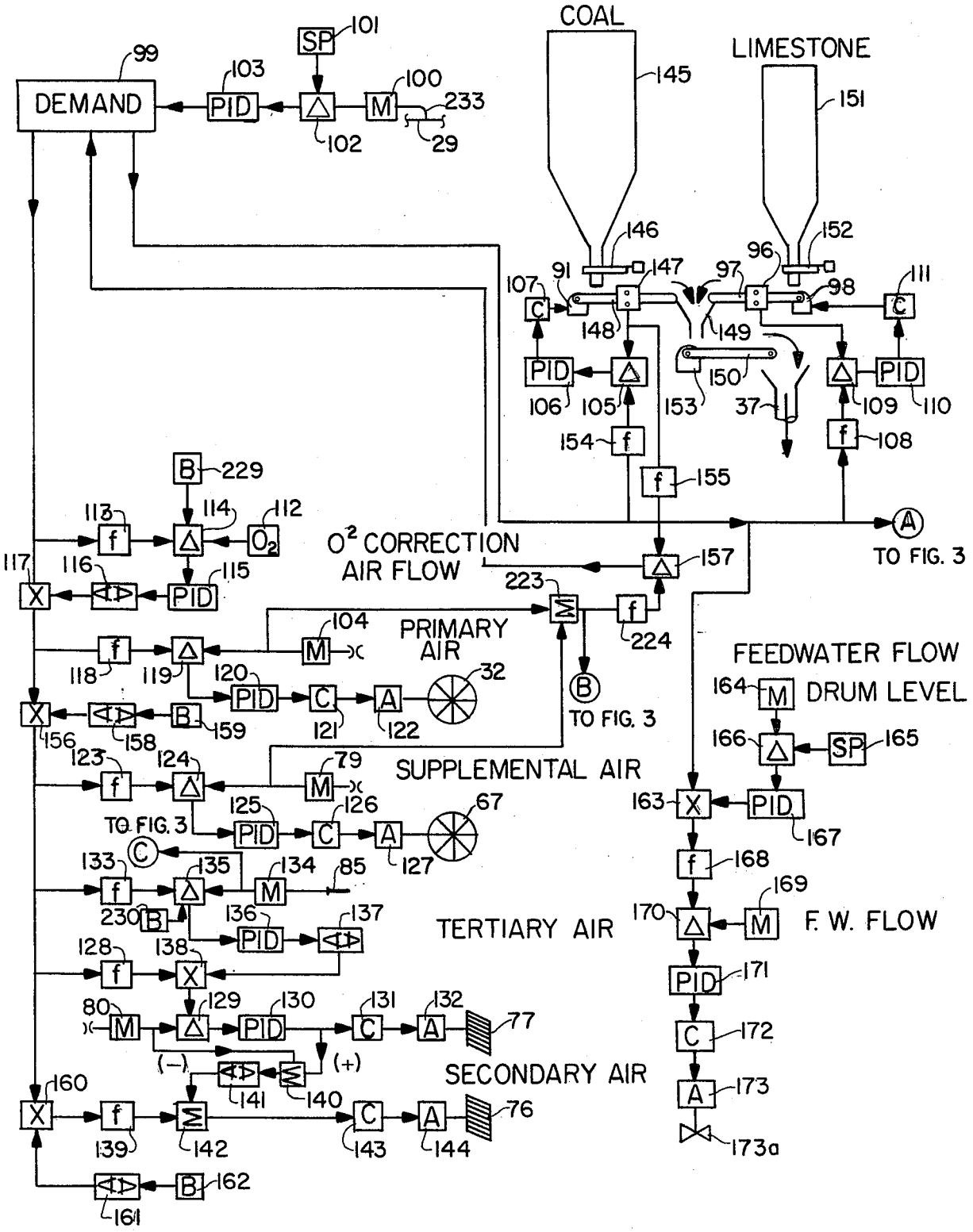
FIG. 2 is a functional diagram of the combustion control system in accordance with the objectives of the invention.

FIG. 2 is a diagram of a representative combustion control system in accordance with the principles of this invention.

Coal bunker 145 is equipped with coal gate 146 at the outlet. Coal from bunker 145 flows through gate 146 to feeder 147 which weighs the coal gravimetrically. The feeder 147 is equipped with belt 148 and power drive/- leveler 91. The metered flow of coal drops into hopper 149. Hopper 149 feeds coal onto belt 150 driven by power unit 153. Belt 149 discharges into conduit 37 which feeds to combustor 30 through conduit 38.

Limestone bunker 151 is equipped with gate 152 at the outlet. Limestone flows through gate 152 to feeder 96 which weighs limestone volumetrically. The feeder is equipped with belt 97 and power drive/leveler 98. The metered flow of limestone also drops into hopper 149. The limestone flows along with the coal to combustor 30.

The above feeders and belting are encased in a pressure tight enclosure (not shown) from the bunkers to conduit 37 and combustor 30.

Demand controller 99 generates load signals to enable steam generator 1 to satisfy the varying demand of the steam consumer receiving steam from conduit 29. If the demand to the boiler is in error, it is corrected by steam pressure error.

Steam pressure in conduit 29 at point 233 is measured in meter 100 and compared to set point 101 in difference unit 102. The error is corrected in Proportional/Integral/Derivative (PID) controller 103 and sent to demand controller 99.

The demand for coal is sent from 99 to function generator 154. Metered value of coal flow is sent from 147 to difference unit 105 and compared with 154 output value. The error is sent to PID unit 106 for correction. Unit 106 through controller 107 adjusts the feed rate of 91 and 147. A similar circuit proportions flow of limestone parallelly with the flow of coal. Units 108, 109, 110 and 111 correspond to units 154, 105, 106 and 107 respectively.

Demand controller 99 generates a demand for air flow for various loadings. The demand for air flow is corrected for actual oxygen in the flue gas as measured by meter 112 (see FIG. 1). This value is compared with the output of function unit 113 in difference unit 114. A bias is provided in unit 229 for local adjustment of set point. The variation or error feeds to PID unit 115 and the corrected output is high/low limited in 116. The unit 116 output signal ratios the demand signal for air supply in unit 117. Thus, the output of 117 is the value which will produce desired excess air in the exhaust gas from the boiler.

The demand for primary air is generated in function unit 118. Primary air metered in venturi 104 is compared with set point in difference unit 119. The error passes through PID unit 120, controller 121 and actuator 122 which positions primary air fan 31 inlet vanes 32.

A bias between primary and secondary air may be set in unit 159 which is high/low limited in unit 158. Unit 158 output ratios demand for supplemental air in unit 156.

Supplemental air flow demand is generated in function unit 123 and compared in unit 124 with actual flow measured in venturi 79. The error is sent to PID unit 125, controller 126 and actuator 127 which positions fan 66 inlet vanes 67.

Supplemental air is distributed between secondary and tertiary ports 39 and 75. As tertiary air damper 77 opens, secondary air damper 76 closes and visa versa. Secondary air is the difference between flow measurement in venturies 79 and 80. In this case secondary air flow control damper position is characterized to load and tertiary air damper 77 position.

Function generator 128 characterizes air damper 77 position vs. load. This value is compared in difference unit 129 to actual air flow as measured in venturi 80. The error is sent to PID unit 130, controller 131 and actuator 132 to position damper 77 for flow control.

Function generator 133 establishes set point for furnace 40 exit gas temperature as measured by thermocouple 85 and meter 134. The values are compared in difference unit 135 and the error is sent to PID unit 136. A bias for temperature offset from unit 133 set point may be made through unit 230. The temperature reading from meter 134 is sent to point C of FIG. 3. The corrected output of unit 136 is high/low limited in unit 137. The error corrects the demand for tertiary air flow in ratio unit 138. Low temperature increases tertiary air flow and visa versa.

Secondary air flow control damper position is characterized in function unit 139. The output error of unit 130 is fed to the secondary air control circuit through summer 140 which isolates the error. The error is high/-low limited in unit 141. Unit 141 output is summed in 142 with the output of function unit 139. Greater than anticipated opening of damper 77 closes damper 76 some amount and visa versa. The output of summer 142 passes to controller 143 and actuator 144 to position secondary air damper 76.

The input to function unit 139 may be ratio offset in unit 160 which receives a bias from unit 162 and is high/low limited in 161.

Measured primary air flow and supplemental air flow is totalized in summer 223, characterized in function unit 224 and compared with total coal flow in difference unit 157 to determine balance of air flow with coal flow. Function unit 155 characterizes coal flow to air flow. The difference from unit 157 is sent to demand controller 99 so that air and coal flows can be controlled in parallel when one of the two is in a limiting condition.

Feedwater flow to conduit 2 and economizer 10 is controlled as follows:

Controller 99 demand is sent to ratio unit 163 where it is corrected for drum water level error as measured and ranged in meter 164. The output of meter 164 is compared with unit 165 set point in difference unit 166. Unit 166 error is sent to PID unit 167 which provides the ratio correction for unit 163. Ratio 163 output is characterized in function generator 168 and compared in delta unit 170 with actual feedwater flow as sensed and ranged in meter 169. Meter 169 measures the feedwater flow to conduit 2. The error is sent to PID unit 171 for correction of valve **173*a* position through controller 172 and actuator 173. Feedwater regulator valve 173*a* is located in the feedwater supply conduit or what could be termed as the extension of conduit 2**.

The above, with the exception of the secondary and tertiary air proportioning controls describes the more conventional aspects of the basic combustion control system for a conventional steam generator including the circulating fluidized bed steam generator covered by this invention.

Figure 3:
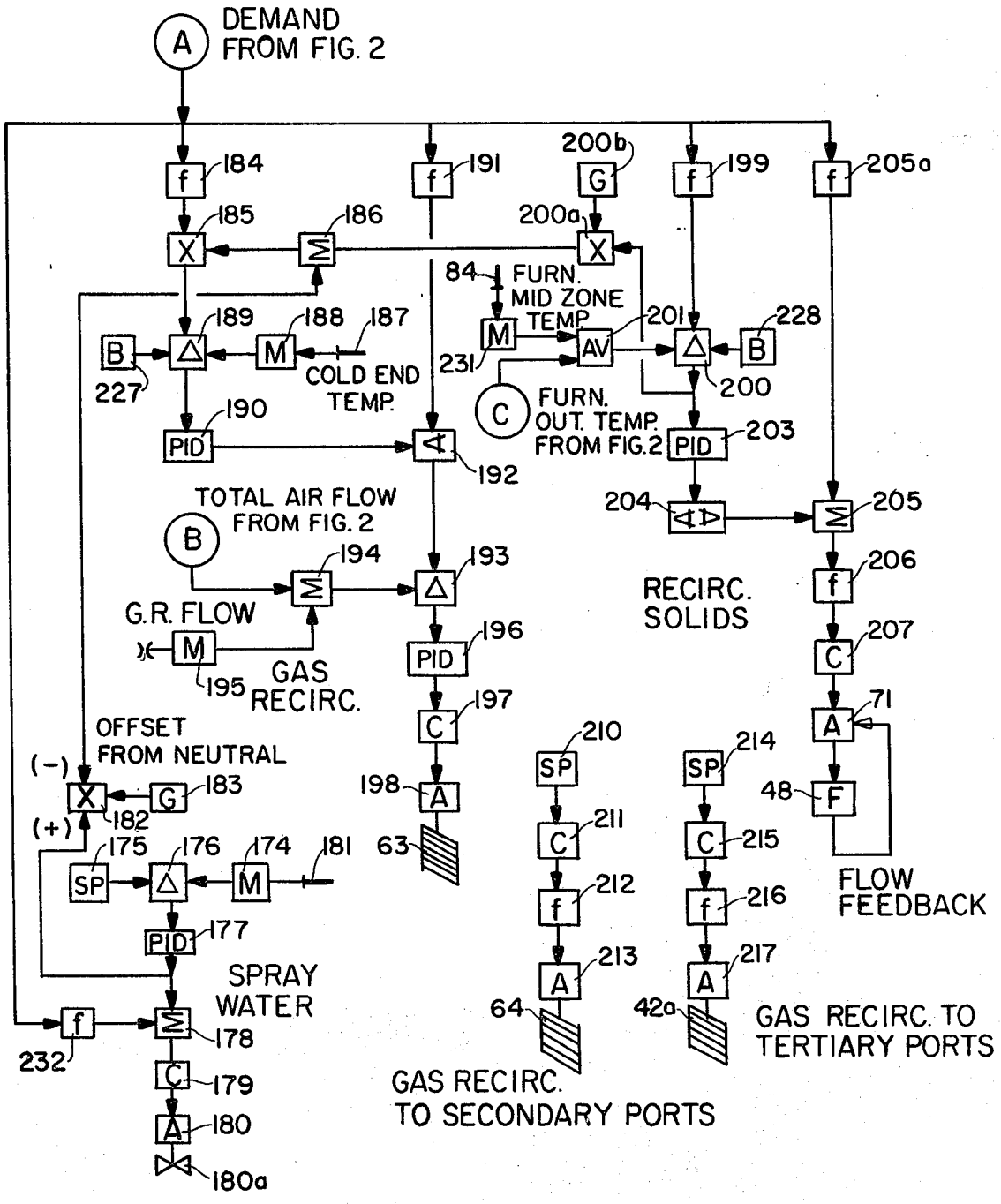
FIG. 3 is a functional diagram of the temperature control system in accordance with the objectives of the invention.

The FIG. 3 diagram interconnects with the FIG. 2 diagram and covers those aspects of the control system which, in coordination with secondary and tertiary air proportioning dampers, balance absorption among the respective steam generator fluid circuits including steam generating, superheating and reheating duty while maintaining furnace gas temperature at a preset level over a variable load range.

An unbalance in heat absorption among the fluid circuits is first detected from steam temperature error. In the case illustrated, no reheating is included. It is anticipated that conventional methods would be used to bring reheat outlet steam temperature in line with superheating outlet steam temperature. This invention relates to a basic means for shifting heat transfer duty among the respective heat absorption circuits which is different from current practice and which can be used in a multiplicity of ways by the boiler designer.

Arrangements of steam generator fluid heat transfer circuits may vary widely to suit the specific needs of individual applications.

The basic means provided by this invention relates to how gas recirculation and recirculated solids mass flow are manipulated in response to temperatures in the steam generator fluid circuits and combustion system gas path.

The starting point is measurement of superheater outlet steam temperature by thermocouple 181 and as ranged in meter 174. Meter 174 output is compared in difference unit 176 with set point from unit 175. The error is sent to PID unit 177.

FIG. 2 demand from controller 99 is sent to FIG. 3, point A which in turn connects to function generator 232. Unit 232 establishes a neutral position for spray water control valve 180*a*. Valve 180*a* is located in conduit 219 (see FIG. 1). Valve 180*a* is actuated by power unit 180 and controller 179. Controller 179 is responsive to summer 178 which receives the neutral position signal from unit 232 and the error correction from PID unit 177.

Flow control valve 180*a* supplies spray water to nozzle 220 in desuperheater 218 at the outlet of primary superheater 3. Spray water is from the same source which supplies feedwater flow to economizer 10 through flow control valve 173*a* and conduit 2. Desuperheater 218 is provided with thermal shield 221 to protect conduit 218 from thermal shock resulting from water injection through nozzle 220.

High steam temperature at point 181 results in increased spray water injection through nozzle 220 of FIG. 1 and visa versa.

The system is designed so that spray water flow will be held at some neutral mid-point position as say 2 percent of total feedwater flow.

Spray water injection is equivalent to increasing evaporating duty and decreasing superheater duty as the spray water is evaporated using heat absorbed from the superheating circuits. In order to restore spray water flow to a neutral value, it is necessary to shift heat absorption between superheating and evaporating duties.

The measure and direction of heat absorption unbalance is the deviation of spray water flow from the neutral value as indicated by the output of PID unit 177.

The output from PID unit 177 feeds to ratio unit 182 where error gain from unit 177 may be increased or decreased through proportional adjustment unit 183. The output of unit 182 connects to summer 186 to initiate a change in gas recirculation flow which will bring the heat distribution in balance in a way which will retard spray water departure from the neutral position.

Demand A connects to unit 191 which generates a minimum set point for total air and gas recirculation flow. Unit 191 outputs to low limiter 192. This insures minimum air/gas flow through the furnace gas path to entrain the minimum amount of recirculated particles in the gas stream for safe operation.

Demand A also feeds to function generator 184 which develops a characterized set point for an indexing means for control of gas recirculation mass flow. The time constants are long for correction of heat absorption among the fluid heat absorption circuits as well as for modulation of the recirculated solid particle mass flow rate. Should the two long time constant interactions be subject to integral corrective action, control stability could be endangered. Proportional corrective action only has been adopted for this case. Proportional measurement is direct, represents a state which currently exists and can be readily combined with other measurements. Non-linear type proportional control could be used to supplement the configuration as shown. In such case, the corrective action would increase as the error departs further from set point.

A temperature measurement at a downstream location of the gas path was chosen as the indexing means. Such measurement would have a relatively short time constant, would respond to a single integral, and would provide control stability.

The following should be considered when selecting the downstream temperature indexing means:

In cases where feedwater supply temperature to economizer 10 is held constant at all times and particularly during times of load variation, as would occur if the source were from a deaerator storage tank maintained at constant pressure and saturation temperature, the indexing means could be gas temperature at the economizer 10 gas outlet as shown by thermocouple 187 (see FIG. 1). Gas temperature would be in a range of 660 to 750 F.

In cases where feedwater supply temperature varies widely either at constant or variable steam generator loading, the indexing means could be gas temperature at the primary superheater 3 gas outlet as shown by thermocouple 187*a* (see FIG. 1). Gas temperature would be about 1160 F. Steam temperature in conduit 25 at the primary superheater outlet as shown by thermocouple 187*b* (see FIG. 1) or other representative point downstream of plenums 43 and 44 could serve as an alternative indexing point.

The objective of any of points 187, 187*a* and 187*b* is to measure the degree of shift in heat absorption ratio between the head and tail ends of the gas path starting from furnace 40 to the point of measurement downstream of plenums 43 and 44. Increase of gas mass flow recirculated decreases heat transfer duty in the head end and increases heat transfer duty in the downstream zones of the flue gas circuit. This decrease/increase or visa versa will be reflected by a change in primary superheater outlet steam temperature, gas temperature along the gas path or other equivalent measurement. The measurement should not be responsive to conditions external to the steam generator.

Indexing point characteristics will be different for alternative disposition of the various portions of the heat transfer circuits. The essence of the invention is that, as a result of the change in gas mass flow, shift of heat absorption among the respective heat transfer circuits can be controlled in a repeatable pattern while at the same time coordinating such control with the control of the mass flow rate of the recirculated solid particulate.

The characterized indexing means set point from unit 184 is increased or decreased in gain through ratio unit 185 which receives proportional error signals from summer 186.

Summer 186 output is the net difference of two errors, one from ratio unit 182 (spray deviation from neutral), the other from unit 200*a* (furnace gas temperature error or recirculated solids mass flow unbalance).

The adjusted demand from unit 185 is the set point for the indexing means which in this case is one of thermocouples 187, 187*a* or 187*b* and for simplicity will be called 187. Temperature measurement is ranged in meter 188. Unit 185 set point is compared with meter 188 output in difference unit 189. The difference may be biased by setter 227 to bring the system into range to suit local conditions.

Unit 189 error is sent to PID controller 190 which develops a new demand for total air and gas recirculation flow.

The corrected demand from unit 190 passes through flow limiter 192 to difference unit 193 where it is compared with total air flow, point B from FIG. 2, and gas recirculation flow as measured in orifice/meter 195. The air and gas flows are totalized in summer 194.

It should be noted that $O_2$ corrects air flow and total flue gas mass flow is controlled by the output of the gas recirculation fan.

The output of difference unit 193 passes to PID unit 196 which develops a new set point for damper 63 position. This signal is sent to controller 197 and actuator 198 which positions damper 63.

With respect to control of furnace gas temperature, function unit 199 generates a set point for average gas temperature in furnace 40. Furnace outlet temperature as measured by thermocouple 85 (see FIG. 1) is sent from FIG. 2 to FIG. 3 via point C. Mid-furnace temperature in the secondary air zone is sensed by thermocouple 84 (see FIG. 1) and is ranged in meter 231. The two temperatures are averaged in unit 201. Difference unit 200 compares average temperature from unit 201 with set point from unit 199. A bias may be entered into unit 200 from unit 228 to compensate for local deviations. The error from difference unit 200 is sent to PID controller 203. The output of 203 is high/low limited in unit 204.

Unit 204 output is totalized in summer 205 with a base demand for recirculated solid particle mass flow generated in unit 205*a*. The output of summer 205 connects to function unit 206 where the signal is characterized. Unit 206 feeds to actuator 71 which controls feed rate through feeder 48 (see FIG. 1). Actuator 71 receives flow feedback from a built in circuit associated with feeder 48.

The average furnace temperature error from difference unit 200 is transmitted to summer 186 via ratio unit 200*a*. The gain of unit 200*a* output can be adjusted through output of setter 200*b*.

Increases in gas recirculation mass flow rate, especially at the secondary air admission ports 39, increases mass flow of solid particles recirculated in the bed. The increased gas velocity entrains a greater portion of the solid particles from the base of the combustor and furnace directly above in the gas stream as the gas stream ehters plenums 43 and 44. This in turn increases heat absorption in the intermediate and final superheater platens 26 and 28 above furnace 40. The increased mass flow of solids to plenums 43 and 44 makes additional heat available to fluid surfaces 89 and 20*f* after particle separation. Furnace gas temperature is lowered.

The decrease in gas recirculation mass flow has the reverse affect.

Gas recirculation and solid particle recirculation mass flow effects may be biased with respect to each other by two means. One method is by increasing or decreasing the amount of solids which are recirculated through regulation of the amount of ash or recirculated solids which is/are removed from combustor 30 or other point in the circulating fluidized bed loop. The second method is to bias gas recirculation flow to ports 39 and 75 through regulation of associated dampers 64 and 42*a* (see FIG. 1). On FIG. 3, manual controls are shown for these dampers.

Units 210 and 214 are position setters, 211 and 215 are controllers which output through characterizers 212 and 216 to actuators 213 and 217 which position dampers 64 and 42*a*.

Ash removal rate from the circulating fluidized bed is coordinated with changes in the recirculated solid particle mass flow rate. The two complement each other. As recirculated particle mass flow rate increases, ash removal rate is decreased and visa versa. Ash removal is a continuous process. At steady state, recirculation and removal rates are constant. Level of ash in hopper 50 at points 88*a*, 88*b* and 88*c* (see FIG. 1) can be used as means for biasing rate of ash removal up or down over a continuing period of time.

The net effect of FIG. 3 gas recirculation and solid particle mass flow rate integrated control is to limit gas recirculation changes for heat absorption balance among the fluid circuits when such correction would have an adverse effect upon an off normal furnace temperature situation and to accelerate gas recirculation mass flow change when such change assists both fluid circuit heat absorption balance and furnace gas temperature correction. Mass flow variation of the recirculated gas will assist either fluid circuit heat absorption balance or furnace temperature correction individually to the extent of the differential error between the two variables.

With respect to dispersion of solid particles in the gas stream of the circulating fluidized bed at the outlet of the furnace, a particle to gas ratio range can be anticipated from 1:150 to 1:350 in terms of volumetric displacement.

Thus, it will be seen that I have provided an efficient embodiment of my invention whereby for a steam generator having a circulating fluidized bed combustion system and evaporating and superheating heat absorption circuits, and during conditions of variable loading, a means is provided to apportion heat generated in the combustion process between steam generating and superheating circuits in a variable manner while maintaining furnace gas temperature at a perset value through selective control of gas and circulating bed solid particle mass flows, recirculated spent gas from a downstream portion of the combustion system flue gas path comprising a portion of the gas mass flow, individual control of the mass flow rates being coordinated to minimize bucking interaction between fluid circuit absorption balance and furnace temperature, the control means utilizing spray water position to determine measure of heat absorption unbalance, control of circulating particle mass flow rate maintaining furnace temperature at a preset value, secondary and tertiary air/gas dampers biasing particle entrainment and temperatures in the respective furnace zones, excess air being controlled independently of total gas flow, including means to vary solid particle storage within the circulating bed cycle, gas recirculation control indexing means comprising temperature measurement at the downstream end of the gas path representative of the degree and direction of the shift in heat absorption among the fluid circuits, and an inverse relationship whereby ash removal from the recirculating loop may be coordinated with recirculating solid particle mass flow rate and in cycle particle storage.

While I have illustrated and described several embodiments of my invention, these are by way of illustration only and various changes and modifications may be made within the contemplation of my invention and within the scope of the following claims:

I claim:

1. A steam generator having a circulating fluidized bed combustion apparatus for generating heat in association with fluid heat absorption circuits, a flue gas path for receiving hot combustion gas from said combustion apparatus, first control means for selectively varying said hot combustion gas mass flow rate in said circulating fluidized bed combustion apparatus including a recirculated spent portion of said combustion gas from a downstream point of said flue gas path as part of said hot combustion gas, said circulating fluidized bed comprising solid particles of inert material and fuel circulated in said combustion gas, second control means for varying mass flow rate of said circulating bed solid particles, said fluid heat absorption circuits being disposed to absorb heat from said hot combustion gas and said circulating bed solid particles, evaporating and superheating portions of said fluid heat absorption circuits being disposed so that heat absorption duty of said portions is responsive to variations in said hot combustion gas mass flow rate, increase in said hot combustion gas mass flow rate increasing heat absorption in one of said portions relative to said other portion and vice versa, means for integrating control of said first and said second control means adapted to distribute said heat generated by said combustion apparatus in a selective manner between/among said portions of said heat absorption circuits, and especially during conditions of variable loading of said steam generator.

2. A steam generator as recited in claim 1 and wherein said second control means is adapted to maintain said mass flow rate of said circulating bed solid particles sufficient to limit combustion gas temperature to a predetermined value as 1550 F.

3. A steam generator as recited in claim 1, said circulating fluidized bed combustion apparatus including a furnace, and wherein said integrated control and said first and said second control means are also adapted to maintain said combustion gas temperature in said furnace at a predetermined set point.

4. A steam generator as recited in claim 3 and wherein said integrated control is also adapted to limit control interaction between said distribution of heat generated and said maintenance of said gas temperature in said furnace at said predetermined set point.

5. A steam generator as recited in claim 3 including means to inject spray water into an intermediate location of said superheating portion of said fluid heat absorption circuits adapted to lower temperature of the effluent from said superheating portion upon an increase in flow rate of said spray water and visa versa, and wherein said integrated control is also adapted to restore said spray water flow rate to a preset value through redistribution. of said heat generated between said portions of said heat absorption circuits.

6. A steam generator as recited in claim 3 including means for recirculating said spent portion of said combustion gas from said downstream point of said flue gas path to multiple points of said furnace, said multiple points being located in tiers at multiple serial elevations of said combustion gas flow path through said furnace, and wherein said integrated control and said first control means is adapted to selectively distribute said recirculating spent portion of said combustion gas between/among said tiers of multiple points responsive to said combustion gas temperature associated with one of said tiers of multiple points.

7. A steam generator as recited in claim 3 including means for supply of combustion air to said combustion apparatus, a third control means adapted to selectively control rate of flow of said air to said combustion apparatus, said integrated control and said first and said third control means being adapted to selectively control excess air in a portion of said flue gas path independently of said hot combustion gas mass flow rate in said circulating fluidized bed combustion apparatus.

8. A steam generator as recited in claim 3 including means for separation of said solid particles from said hot combustion gas, means for transport of said separated solid particles to the upstream portion of said circulating fluidized bed combustion apparatus, means for storage of said separated solid particles in said transport means, means for selectivelly controlling quantity of said solid particles stored in said storage means within some predetermined quantitative range.

9. A steam generator as recited in claim 8 and including means for removal of a spent portion of said solid particles from said combustion apparatus and/or transport means, means for indexing the need for removal of a portion of said spent portion of said solid particles with said second control means and/or with said means for controlling quantity of said solid particles stored in said storage means.

10. A steam generator as recited in claim 3 and wherein said first control means is responsive to a temperature measurement point associated with the downstream portion of said flue gas path, temperature variation at said temperature measurement point being responsive to a shift in heat absorption between/among said portions of said heat absorption circuits.

* * * * *